United States Patent [19]

Feldkämper

[11] Patent Number: 4,508,529

[45] Date of Patent: Apr. 2, 1985

[54] APPARATUS FOR FOLDING PAPER SACKS TO Z SHAPE

[75] Inventor: Richard Feldkämper, Lengerich, Fed. Rep. of Germany

[73] Assignee: Windmoller & Holscher, Lengerich, Fed. Rep. of Germany

[21] Appl. No.: 490,889

[22] Filed: May 2, 1983

[30] Foreign Application Priority Data

May 3, 1982 [DE] Fed. Rep. of Germany ..... 3216505

[51] Int. Cl.[3] ..... B31F 1/00

[52] U.S. Cl. ..... 493/438; 493/441

[58] Field of Search ..... 493/438, 437, 441, 455, 493/460

[56] References Cited

U.S. PATENT DOCUMENTS

| | | | |
|---|---|---|---|
| 1,949,495 | 3/1934 | Simmons | 493/438 |
| 1,979,253 | 11/1934 | Cory | 493/438 |
| 2,159,727 | 8/1956 | Bromberg | 493/438 |
| 2,887,313 | 5/1959 | Malott | 493/438 |
| 3,266,391 | 8/1966 | Lopez | 493/438 |
| 3,316,819 | 5/1967 | Cohn | 493/438 |

*Primary Examiner*—Leon Gilden

*Attorney, Agent, or Firm*—Fleit, Jacobson, Cohn & Price

[57] ABSTRACT

In an apparatus for folding paper sacks to Z shape, co-operating scoring wheels are provided on both sides of the conveying plane of an inlet double belt conveyor consisting of individual double conveyor belts disposed at the ends of the articles. The scoring wheels are spaced apart by a distance equal to the desired spacings of the fold-lines of the Z folds and are mounted on pairs of shafts parallel to the roller shafts of the inlet conveyor. One of the individual belts adjoins a double conveyor belt which extends obliquely to the other and which is extended by a straight individual belt which, in relation to the inlet conveyor, is closer to the other individual belt by a distance equal to the shortening of the articles caused by the folding. The end rollers of the upper and lower belts of the oblique double belt conveyor with the adjacent rollers of the straight conveyor belts can be alternately raised from the rollers of the associated double belt conveyor so that each passing sack is clamped by only one pair of rollers. Over substantially the length of the oblique conveyor belt, a folding bar is provided above and another below the conveying planes. These bars extend in the conveying direction from a position beyond the scored zones of the sacks, pass through the conveying plane in opposite senses, also intersect in a vertical plane and terminate at a spacing from each other substantially in a horizontal plane.

5 Claims, 7 Drawing Figures

APPARATUS FOR FOLDING PAPER SACKS TO Z SHAPE

The invention relates to an apparatus for placing continuously transversely fed flat articles into Z folds, preferably tube sections or sacks of paper.

After manufacture, paper sacks are usually stacked, bundled and deposited on pallets for transporting the stacks. The pallets have to correspond in size to the length and breadth of the flattened sacks and therefore take up unnecessarily large storage space. The height of the stacks of paper sacks is governed by the height of the superposed cross-bottoms because, in contrast with the central regions of the socks, many layers of sack material are superposed in the base regions. Thus, in the case of stacks of cross-bottom sacks, the opposed sides of the stack are elevated in relation to the sagging central region of the stack. This leads to untidy stack shapes and a waste of space.

The invention is based on the recognition that more compact stacks taking up less storage space and being tidier and more stable can be formed from cross-bottom sacks if the zone of the flattened sacks disposed between the cross-bottoms at the ends is folded to Z shape, so that the doubly transversely folded sacks have a height at the central zone corresponding to that at the bases.

It is therefore the problem of the invention to provide an apparatus for folding paper sacks to Z shape, especially cross-bottom sacks, so that they can be superposed to form edge-aligned stacks which are more compact.

According to the invention, this problem is solved in that on both sides of the conveying plane of an inlet double belt conveyor consisting of individual double conveyor belts disposed at the respective ends of the articles, co-operating scoring wheels are provided at transverse spacings corresponding to the desired spacings of the folded edges of the Z folds on pairs of shafts parallel to the roller shafts of the inlet double belt conveyor, that one of the individual belts adjoins a double conveyor belt which extends obliquely to the other and which is extended by a straight individual double conveyor belt, which, in relation to the inlet double belt conveyor, is closer to the other individual double conveyor belt by a distance equal to the shortening of the articles caused by the Z folding, that the end direction-changing rollers of the upper and lower belt of the oblique double conveyor belt with the adjacent direction-changing or drive rollers of the straight conveyor belts can be alternately raised from the direction-changing rollers of the associated conveyor belt so that each passing article is clamped by only one pair of rollers, and that over substantially the length of the oblique double conveyor belt a folding bar is provided above and another below the conveying planes, which bars extend in the conveying direction from a position beyond the scored zones of the articles, pass through the conveyor plane in opposite senses, also intersect in a vertical plane and terminate at a spacing from each other substantially in a horizontal plane. The apparatus of the invention permits the central zones between the bases at the ends of the cross-bottom sacks to be folded to Z shape in synchronism with the manufacture of the sacks whilst they are passing through the apparatus, so that the sacks are shortened by half their length and can be superposed to form correspondingly smaller more stable and more compact stacks. The two folding bars are disposed so that over their length they each execute substantially half a helical convolution relatively to each other.

The apparatus of the invention can also be employed for folding tube sections, for example when, in the case of different lengths, it is desired to shorten them so that the means for forming the bases can always be disposed at the same distance from each other.

In the apparatus of the invention, the prescored sacks or articles are clamped by the folding bars during their folding between the straight double conveyor belt and the oblique double conveyor belt, the disposition of the oblique belt being selected so that shortening of the sacks or articles during formation of the Z fold is taken into account.

To avoid stresses when entering and leaving the oblique double conveyor belt, the rollers of the double conveyor belts can be lifted off each other in opposite senses in the transfer zones.

To enable the apparatus to be set in a simple manner to different sizes and hence to different widths of the Z folding, the rollers of the oblique double conveyor belt as well as those of the adjoining double conveyor belts are adjustable in their spacing to the other straight double conveyor belt.

One example of the invention will now be described in more detail with reference to the drawing, wherein.

Figure 1:
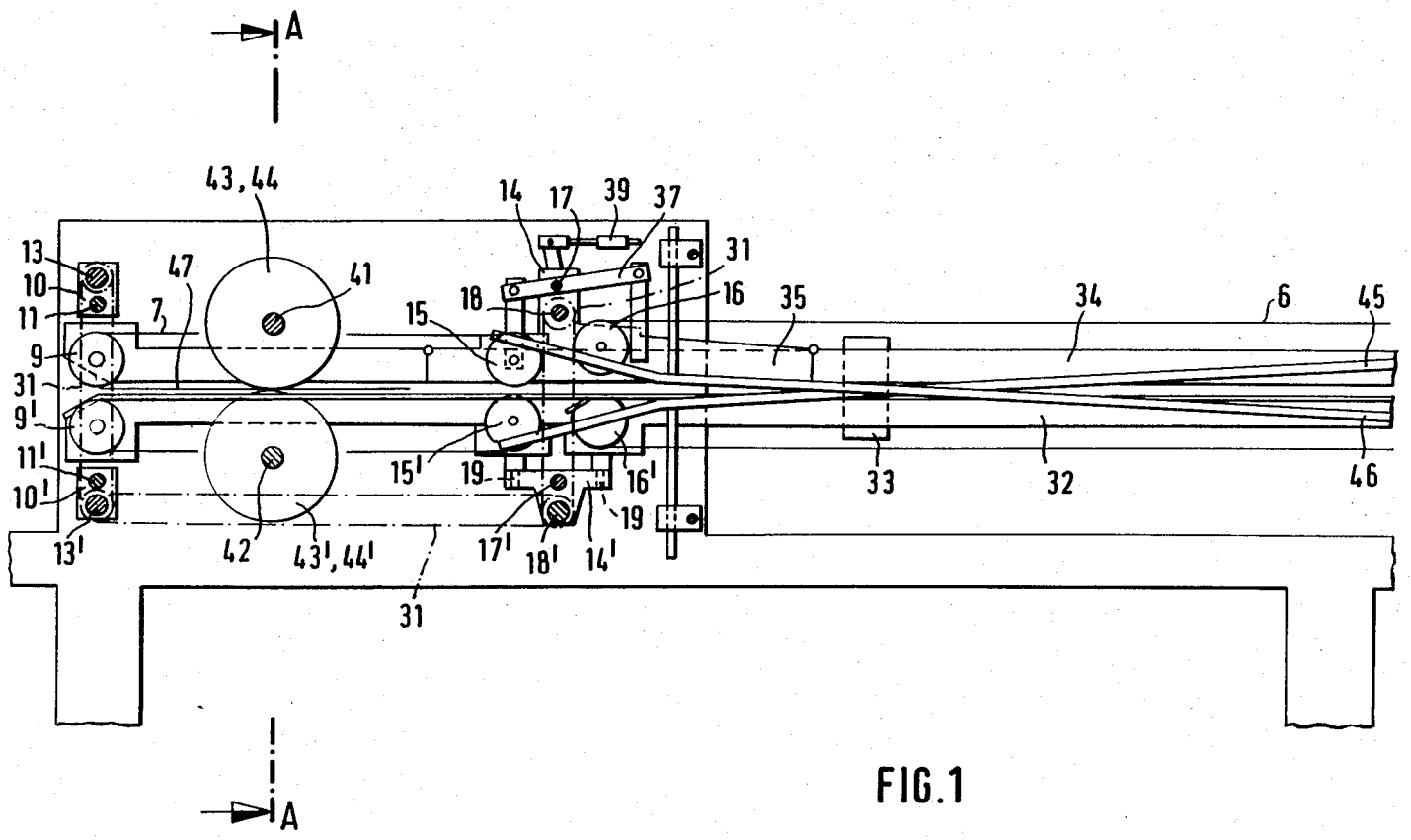
FIGS. 1 and 2 are a side elevation of the apparatus.
Figure 2:
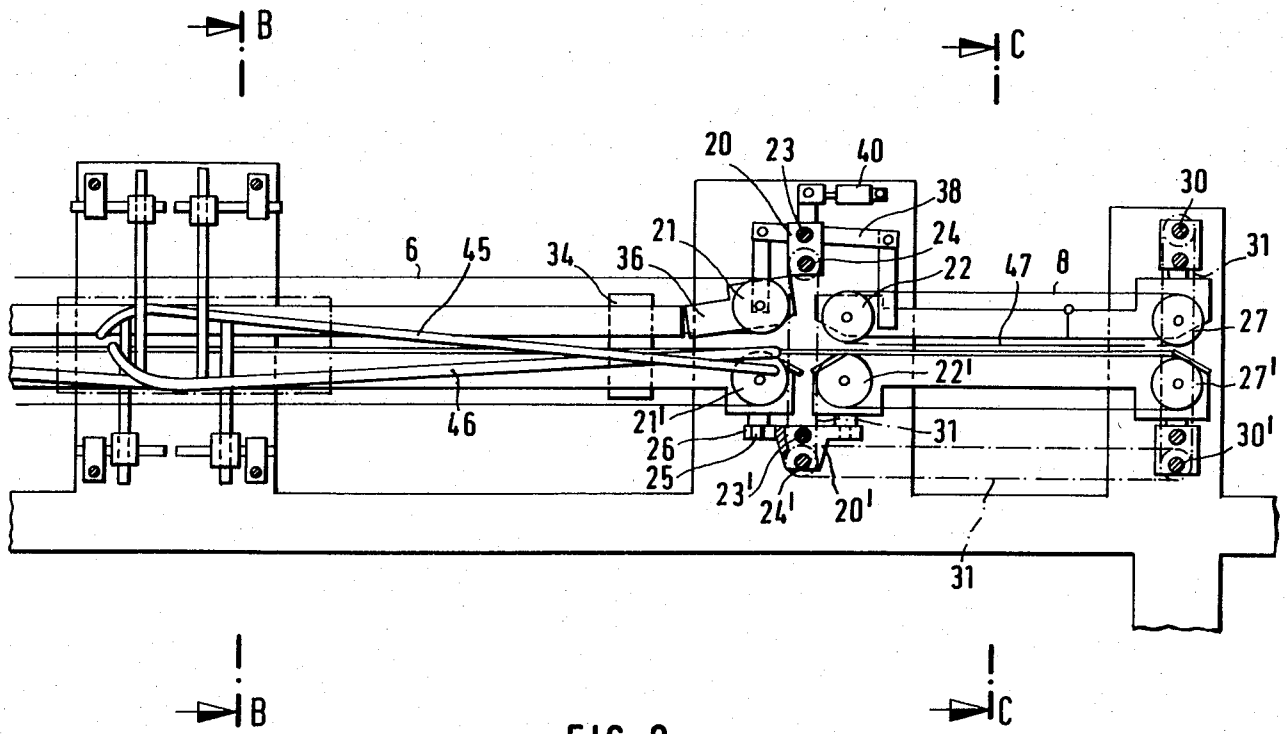
Figure 3:
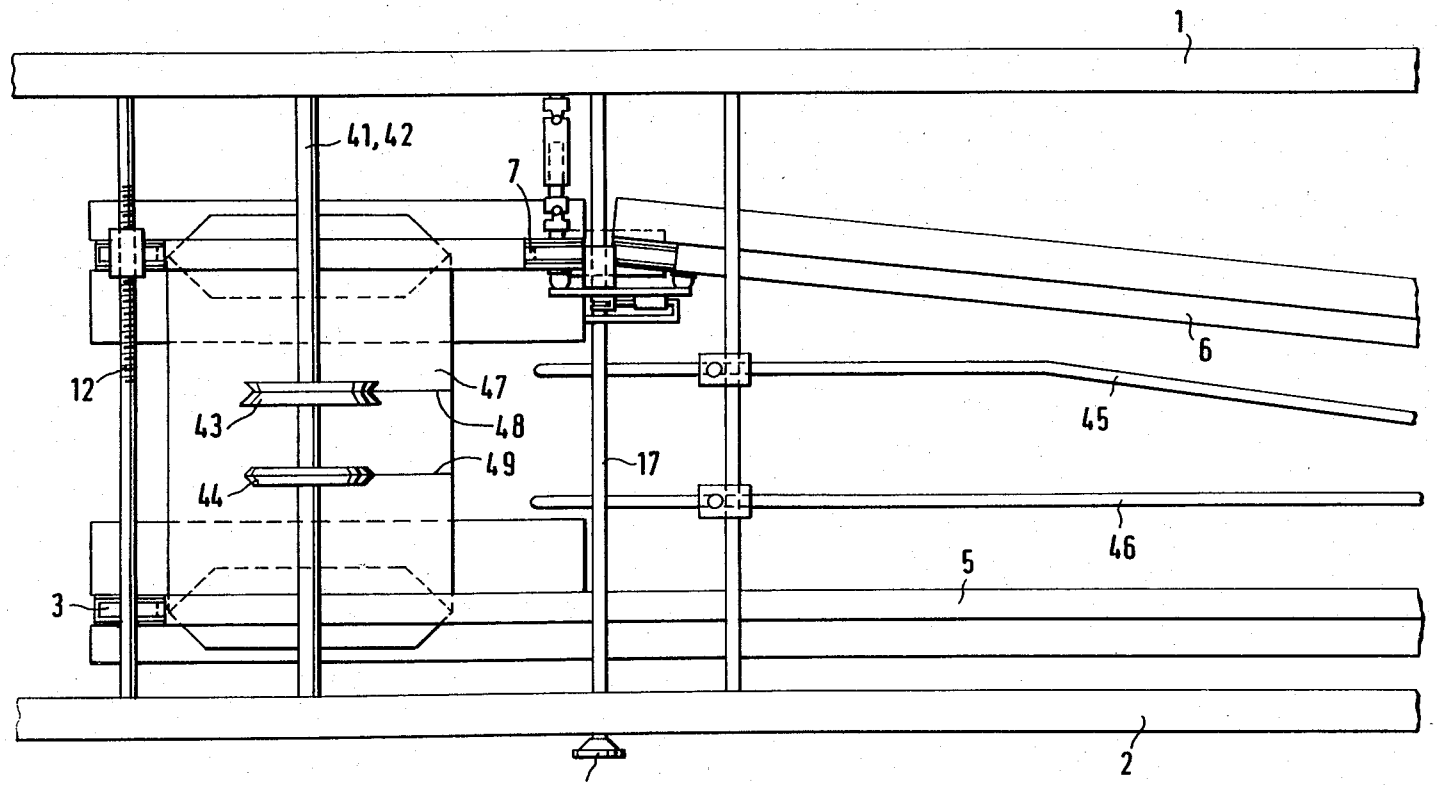
FIGS. 3 and 4 are a plan view of the apparatus.

The side walls 1, 2 of the machine frame mount the spindles or shafts for the drive and direction-changing rollers 3, 4 of the throughgoing double conveyor belt 5 disposed parallel to the side wall 2 and for the oblique double conveyor belt 6 as well as for the short double conveyor belts 7 and 8 which surround the latter. The direction-changing rollers 9, 9' of the short double conveyor belt 7 of the inlet belt conveyor are mounted in plummer blocks 10, 10' which are guided for transverse displacement on guide bars 11, 11' secured in the side walls 1, 2 and are transversely adjustable by shafts 13, 13' mounted in the side walls 1, 2 and provided with sections having screwthreads 12. The sections of shafts 13, 13' provided with the screwthreads 12 are screwed into complementary parts of the plummer blocks 10, 10' provided with internal screwthreads.

The plummer blocks 14, 14' for the driven rollers 15, 15' of the double conveyor belt 7 as well as the rollers 16, 16' for the oblique double conveyor belt 6 are transversely displaceable on guide bars 17, 17' secured in the side walls 1, 2 and are transversely adjustable by way of shafts 18, 18' provided with screwthreads. The respective bearings are pivotable about vertical pins 19 on the plummer blocks 10, 10' and 14, 14' so that angle differences occurring during the adjustment can be readily balanced out.

The plummers blocks 20, 20' for the drive rollers 21, 21' of the oblique double conveyor belt 6 and for the drive rollers 22, 22' of the double conveyor belt 8 are analogously transversely displaceable on guide bars 23, 23' and adjustable in the transverse direction by way of shafts 24, 24' provided with screwthreads. Upon a change in the angle of inclination of the oblique double conveyor belt 6, to provide a simple change in length of the pivot pin 25 for mounting the driven rollers 21', the pin is additionally displaceable in an elongated hole 26 of plummer block 20'.

Finally, the bearings of direction-changing rollers 27, 27' of the double conveyor belt 8 are likewise mounted on plummer blocks which are transversely adjustable by way of guide bars and shafts having screwthreads.

To enable the apparatus to be simply adapted to differently wide paper cross-bottom sacks, the shafts 18' and 24' having the screwthreads are provided with hand wheels 28, 29 on the stubs passing through the side walls 2. For turning shafts 18, 10 and 10' in the same sense as well as the corresponding adjusting shafts 24, 24' and 30, 30', sprockets for endless chains 31 are keyed to the shafts.

All the conveyor belts are covered by housings of U-section, the lower housings 32 of the oblique double conveyor belt 6 being connected to the bearings for the direction-changing and drive rollers and carrying the upper covering housings 34 by way of supporting frames 33 connected thereto. The ends 35, 36 of the upper covering housings are hinged to the central portion of the covering housing 34 so that the bearings of the upper direction-changing and drive rollers 16, 21 can be lifted with the pivotable ends 35, 36 of the housing 34. The bearings of direction-changing rollers 15, 16 and drive rollers 21, 22 are articulated by coupling bars to rocker-like supports 37, 38 which are pivotally mounted in the plummer blocks 14, 20 and, for alternately raising and lowering the rollers, can be pivoted by piston-cylinder units 39, 40.

The driven rollers 15, 21, 22 are connected to their drives by way of cardan shafts with plug connections for the purpose of length adjustment.

Scoring wheels 43, 43' and 44, 44' co-operating in respective pairs are mounted on parallel shafts 41, 42 in the central region between the rollers 9, 9' and 15, 15' of the inlet double belt conveyor.

To adjust the spacing between the scoring wheels, their hubs are secured to the shafts by way of clamping screws.

Figure 4:
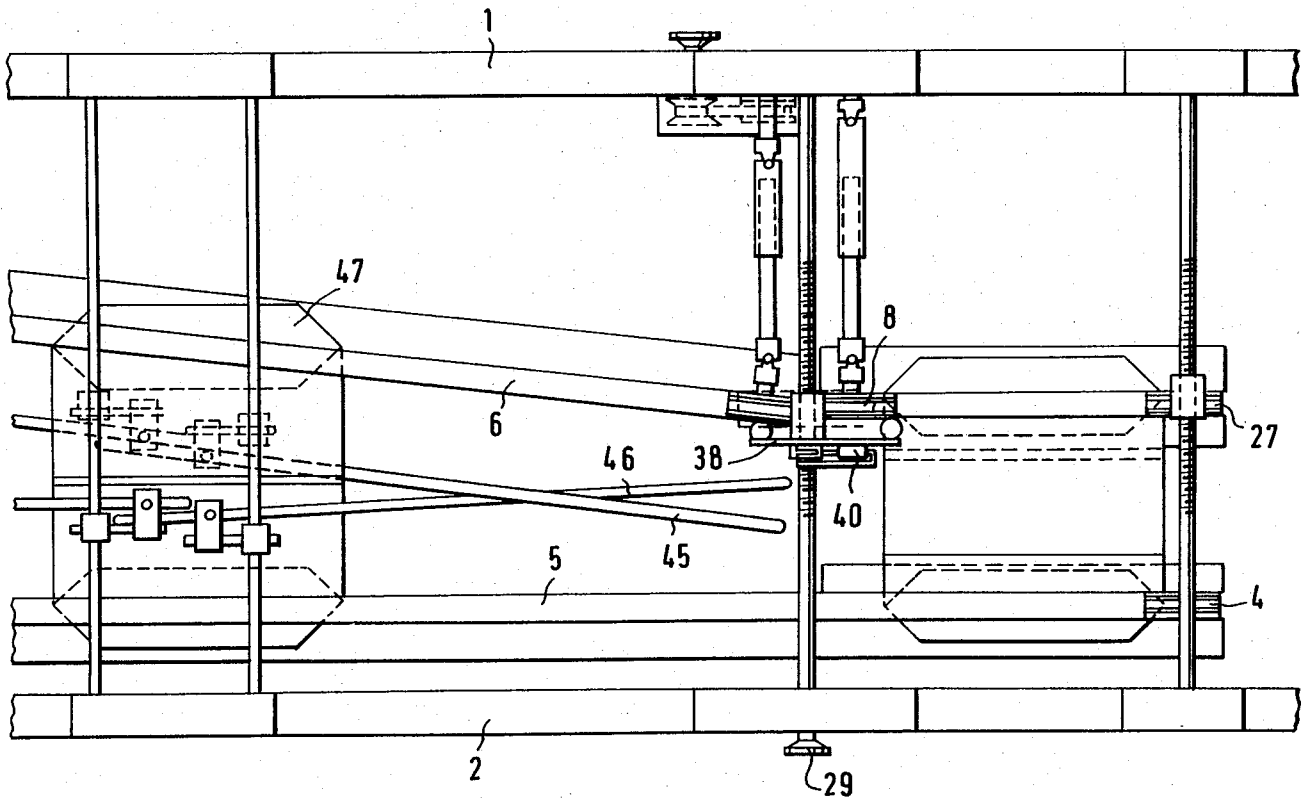
Figure 5:
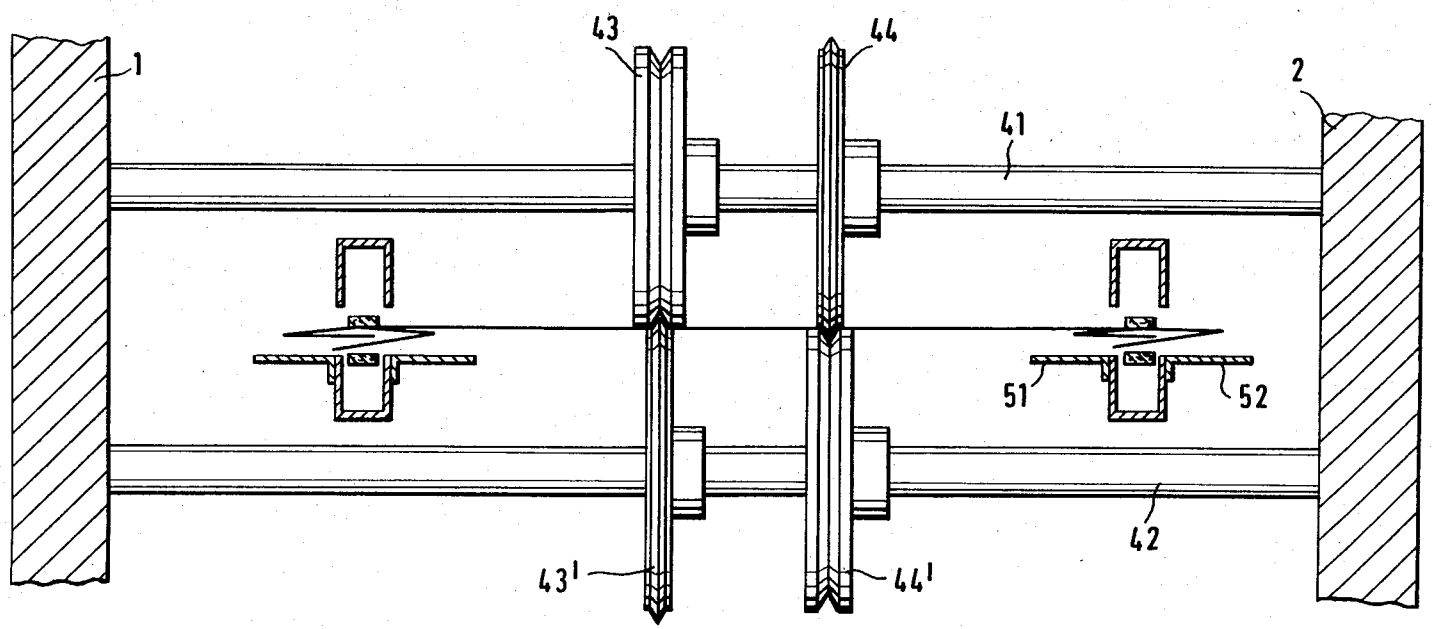
FIG. 5 is a section on the line A—A in FIG. 1.
Figure 6:
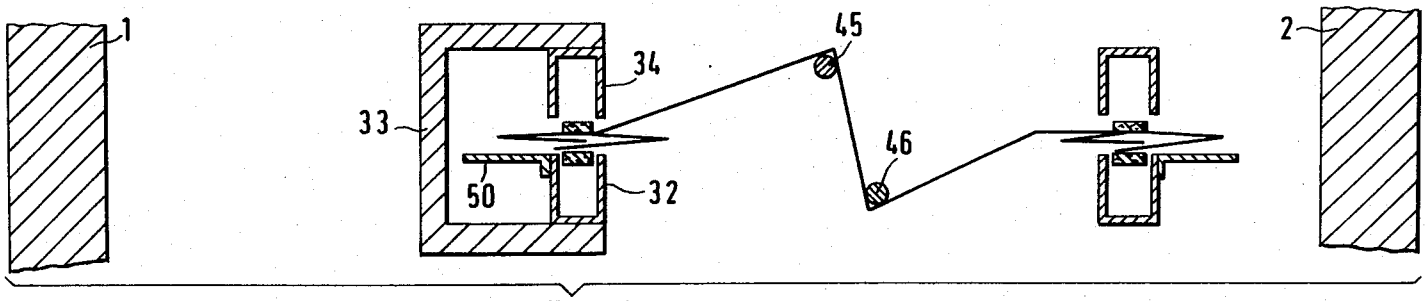
FIG. 6 is a section on the line B—B in FIG. 2.
Figure 7:
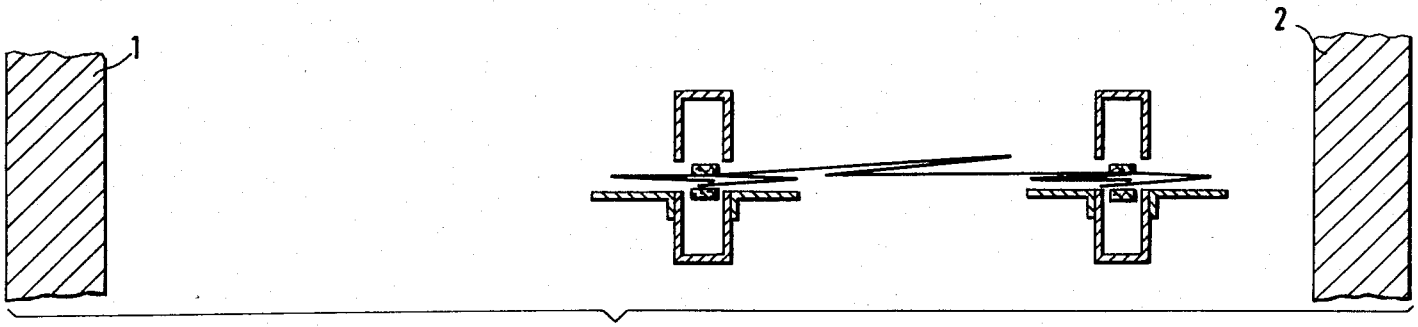
FIG. 7 is a section on the line C—C in FIG. 2.

Over the length of the oblique double conveyor belt 6, folding bars 45, 46 are secured to supporting bars in the machine frame. These folding bars are wound about each other in the form of half a helical convolution and place the sack 47 into Z folding about the prescored fold lines 48, 49, as is shown in FIGS. 4 and 5.

Instead of the folding bar 46, a straight folding blade can be provided about which the other folding bar 45 places the sack 47 into a Z-shaped fold during its passage through the apparatus.

Flange-like extensions 50, 51, 52 secured to the lower housing-like covers serve to support the travelling sacks 47.

I claim:

1. Apparatus for placing continuously transversely fed flat articles into Z folds, preferably tube sections or cross-bottom sacks of paper, characterised in that, on both sides of the conveying plane of an inlet double belt conveyor consisting of individual double conveyor belts disposed at the respective ends of the articles, co-operating scoring wheels are provided at transverse spacings corresponding to the desired spacings of the folded edges of the Z folds on pairs of shafts parallel to the roller shafts of the inlet double belt conveyor, that one of the individual belts adjoins a double conveyor belt which extends obliquely to the other and which is extended by a straight individual double conveyor belt which, in relation to the inlet double belt conveyor, is closer to the other individual double conveyor belt by a distance equal to the shortening of the articles caused by the Z folding, that the end direction-changing rollers of the upper and lower belt of the oblique double conveyor belt with the adjacent direction-changing or drive rollers of the straight conveyor belts can be alternately raised from the direction-changing rollers of the associated double conveyor belt so that each passing article is clamped by only one pair of rollers, and that over substantially the length of the oblique double conveyor belt a folding bar is provided above and another below the conveying planes, which bars extend in the conveying direction from a position beyond the scored zones of the articles, pass through the conveying plane in opposite senses, also intersect in a vertical plane and terminate at a spacing from each other substantially in a horizontal plane.

2. Apparatus according to claim 1, characterised in that the direction-changing rollers alternately applied to the backing rollers are mounted on rockers actuated by piston-cylinder units.

3. Apparatus according to claim 1, characterised in that the belts of the individual double conveyor belts extend in U-shaped housings, the central zone of the upper housing of the oblique double belt conveyor is connected to the lower housing by yoke-shaped supporting members, and pivotable housing members connected to the bearings of the pivotable rollers are pivoted to the central zone of the upper housing at both sides.

4. Apparatus according to claim 1, characterised in that the direction-changing and drive rollers of the oblique double conveyor belt and of the straight double conveyor belts adjoining both sides are mounted by way of spindle drives in plummer blocks which are adjustable parallel to themselves, and that the bearings of the rollers of the oblique double conveyor belt are mounted in the plummer blocks to pivot about vertical axes.

5. Apparatus according to claim 1, characterised in that one folding bar is replaced by a folding blade about which the other folding bar is wound substantially helically.

* * * * *